US006913060B2

(12) United States Patent
Chandaria

(10) Patent No.: US 6,913,060 B2
(45) **Date of Patent: *Jul. 5, 2005**

(54) ADHESIVE TAPE DISPENSER

(75) Inventor: Ashok V. Chandaria, Nairobi (KE)

(73) Assignee: Conros Corporation, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/232,236

(22) Filed: Aug. 29, 2002

(65) Prior Publication Data

US 2004/0040670 A1 Mar. 4, 2004

(51) Int. Cl.[7] ..... B32B 31/00; B26F 3/02

(52) U.S. Cl. ..... 156/527; 156/523; 156/577; 156/579; 225/56; 225/65; 225/66; 225/77; 225/91

(58) Field of Search ..... 156/577, 574, 156/579, 576, 523, 527, 538, 539, 540, 543; 225/56, 65, 66, 77, 91, 57; D19/67, 69

(56) References Cited

U.S. PATENT DOCUMENTS 3,623,643 A * 11/1971 Ikeda ..... 225/65
4,036,471 A * 7/1977 Allen et al. ..... 254/28
4,512,601 A * 4/1985 Jacobstein ..... 294/1.2
D308,891 S * 6/1990 Harris ..... D19/69
5,048,738 A * 9/1991 Cardamone ..... 225/56
D323,187 S * 1/1992 Harris ..... D19/69
5,468,332 A * 11/1995 Dretzka et al. ..... 156/527
6,000,455 A * 12/1999 Semmler ..... 156/540
6,313,451 B1 * 11/2001 Vidmar et al. ..... 219/757
6,719,180 B2 * 4/2004 Shah ..... 225/56
2003/0085250 A1 * 5/2003 Shah ..... 225/65

* cited by examiner

*Primary Examiner*—Chris Fiorilla
*Assistant Examiner*—Cheryl N. Hawkins
(74) *Attorney, Agent, or Firm*—Sand & Sebolt

(57) ABSTRACT

An adhesive tape dispenser having an improved mechanism for gripping the device while dispensing tape. The dispenser has spaced apart side walls and an upper wall connected thereto. The upper wall has a leading edge that is provided with a blade for cutting the adhesive tape. The upper wall is also provided with a shallow recess for placement of the index finger of the user. The recess may include a plurality of corrugations. The position of the recess allows the user to have both an improved grip on the dispenser and to apply directed pressure to the upper wall thereby allowing the tape to be cut more easily. The upper wall of the dispenser is also provided with wings that offer increased protection to the palm of the user's hand so that the rotating roll of tape does not cause injury to the user.

17 Claims, 8 Drawing Sheets

ADHESIVE TAPE DISPENSER

BACKGROUND OF THE INVENTION

1. Technical Field

This invention generally relates to an adhesive tape dispenser. More particularly, the invention relates to an adhesive tape dispenser for dispensing packaging tape without the use of a tape gun. Specifically, the invention relates to an adhesive tape dispenser that includes an improved mechanism for gripping the device while dispensing tape and that aids in preventing the free end of the tape from becoming reattached to the roll when the device is not in use.

2. Background Information

There are numerous types of adhesive tapes that have a wide variety of uses. One of the more frequently used adhesive tapes is packaging tape which is used to secure the flaps of boxes and packages for shipping. This type of tape is wide and is fairly difficult to pull off a roll by hand and manoeuver into position around a package. A device was therefore developed to assist in dispensing and applying this type of tape to a package. The device is commonly known as a tape gun. While tape guns have made it easier to dispense packaging tape, they are cumbersome and they are not always easily reloaded. Additionally, tape guns are fairly large and this creates somewhat of a storage problem for the user.

In order to overcome these disadvantages, several devices have been proposed in the prior art for dispensing packaging tape without the use of a tape gun. These devices are small, lightweight dispensers that typically are "P"-shaped when viewed from the side. The roll of packaging tape is inserted into the upper part of the "P" and a cutting edge is provided at the base of the "P". The devices are adapted to be held in such a manner that the user's index finger rests on a support located near to the cutting edge, the thumb rests on one side of the device and at least one other finger rests on the other side of the device. The device consequently is held within the palm of the hand and is gripped between the thumb and a finger. The index finger support allows the user to apply downward pressure to the area near the cutting edge in order to cut the tape.

While these prior art devices have allowed for dispensing of tape without a tape gun, they have not always been easy to operate with one hand inasmuch as they are flimsy, difficult to grip and frequently allow the user's hand to come into contact with the rapidly rotating packaging tape, potentially causing minor injury to the user.

There therefore still exists the need in the art for a simple, effective adhesive tape dispenser that is adapted to be easily gripped in one hand and allows the packaging tape to be easily dispensed therefrom with one hand, yet that protects the hand of the user during operation.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

The adhesive tape dispenser of the present invention is shown generally by the number 10.

Figure 1:
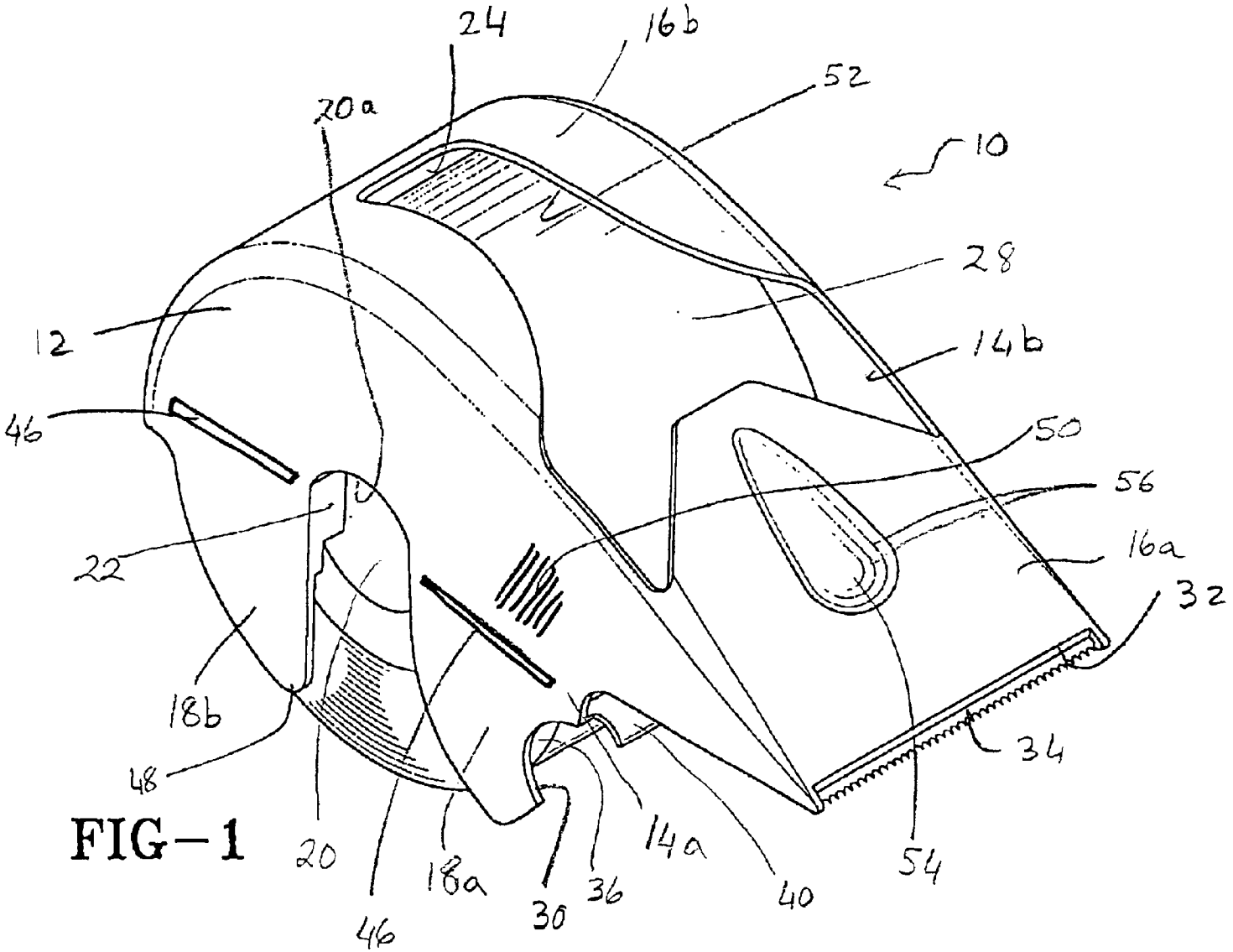
FIG. 1 is a perspective view of an adhesive tape dispenser in accordance with the present invention.

As shown in FIG. 1, dispenser 10 comprises a base 12 that is preferably molded from plastic, metal or some other suitable material. Base 12 includes two spaced apart, generally "P" shaped side walls 14 that are joined together by a convexly-shaped upper wall 16. It will be understood by those skilled in the art that side walls 14 and upper wall 16 may be integrally formed or alternatively may be connected together by a suitable means such as adhesive or rivets. The head of the "P" shape of side walls 14 is open so that side walls 14 form two downwardly extending legs 18 separated by a channel 20. Side walls 14 have an interior surface 14*b* and an exterior surface 14*a*. An inwardly extending guide 22 is provided on the interior surface 14*b* of each of the first and second legs 18*a*, 18*b* proximate the upper end 20*a* of the channel 20. The guides 22 of each side wall 14 project into a gap 24 defined by side walls 14 and are collectively adapted to retain a roll 28 of adhesive tape 26 between them.

Upper wall 16 extends beyond the front edge 30 of first leg 18*a* and terminates in a leading edge 32. Leading edge 32 may be adapted to receive a metallic serrated blade 34 that is retained on leading edge 32 by a suitable means such as rivets or glue. Alternatively, serrated blade 34 may be integrally formed with upper wall 16 and be manufactured from the same material as upper wall 16. Serrated blade 34 is adapted to cut the adhesive tape 26 when tape 26 is brought into contact with it. While blade 34 is shown with serrations, it will be understood by those in the art that any type of blade that will cut tape 26 will be suitable without departing from the scope or intent of this invention.

Figure 10:
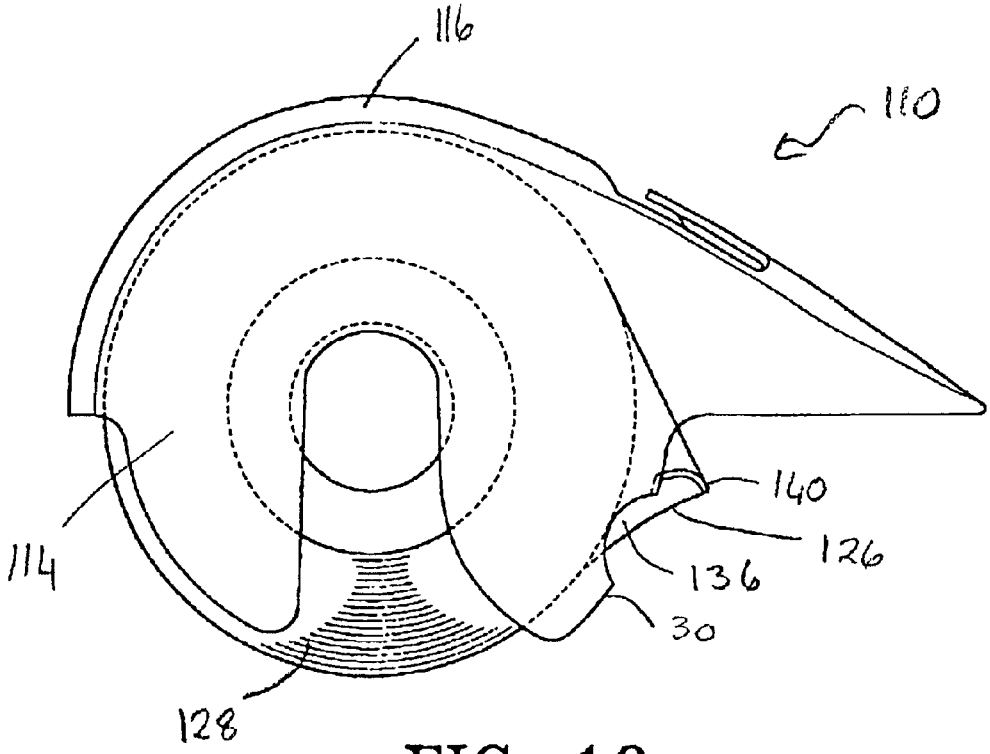
FIG. 10 is a second embodiment of the tape finger lift of the dispenser.
Figure 11:
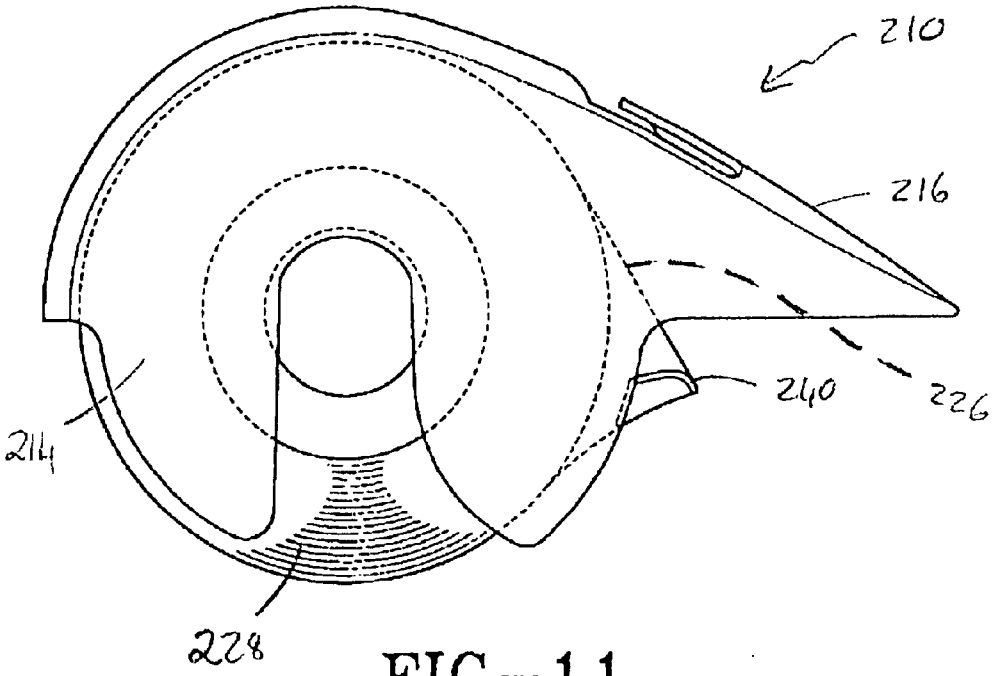
FIG. 11 is a third embodiment of the dispenser showing a third possible finger lift for the severed edge of the tape.

Front edge of first leg 18*a* of each side wall 14 preferably defines a generally "U"-shaped or semi-circular indentation 36 (FIGS. 1–10) that is configured to receive a user's fingertip 38 therein. Indentation 36 may be fairly deep as shown in FIG. 3 or fairly shallow as shown in FIG. 10. Alternatively, as shown in FIG. 11, there may not be any indentation on front edge 30. Indentation 36 allows the user to insert a fingertip 38 into indentation 36 to capture the free end 42 of tape 26 (FIG. 7).

Each first leg 18*a* of side walls 14 is also preferably provided with a lip 40 disposed on either front edge 30 or interior surface 14*b* of side wall 14. Lips 40 project outwardly from front edge 30 towards leading edge 32 of upper wall 16 and project at least partially inwardly into gap 24 between side walls 14. Alternatively lip 40 may extend from front edge 30 of one side wall 14 to front edge 30 of the other side wall 14. Lips 40 may be integrally formed with side walls 14 or they may be attached thereto by suitable a means such as an adhesive. As may be seen from FIGS. 3 and 11, lips 40 may project toward leading edge 32 to a greater or lesser degree. The dispenser 10 selected for loading any specific type of packaging tape may vary based on the type of lip 40 the dispenser has and the desired distance that needs to be maintained between free end 42 and roll 28. Lips 40 are adapted to support free end 42 of tape 26 when a roll 28 is retained on guides 22. In this manner, free end 42 is kept a spaced distance from roll 28 and is therefore readily available when the user Side walls 14 may also be provided with ridges 46 to restrict the sliding of a user's hand downwardly toward the tips 48 of legs 18 when the user grasps dispenser 10. A plurality of knurls 50 are also provided on side walls 14 to aid in the gripping of dispenser 10 and to somewhat restrict forward motion of the user's hand during use.

Figure 2:
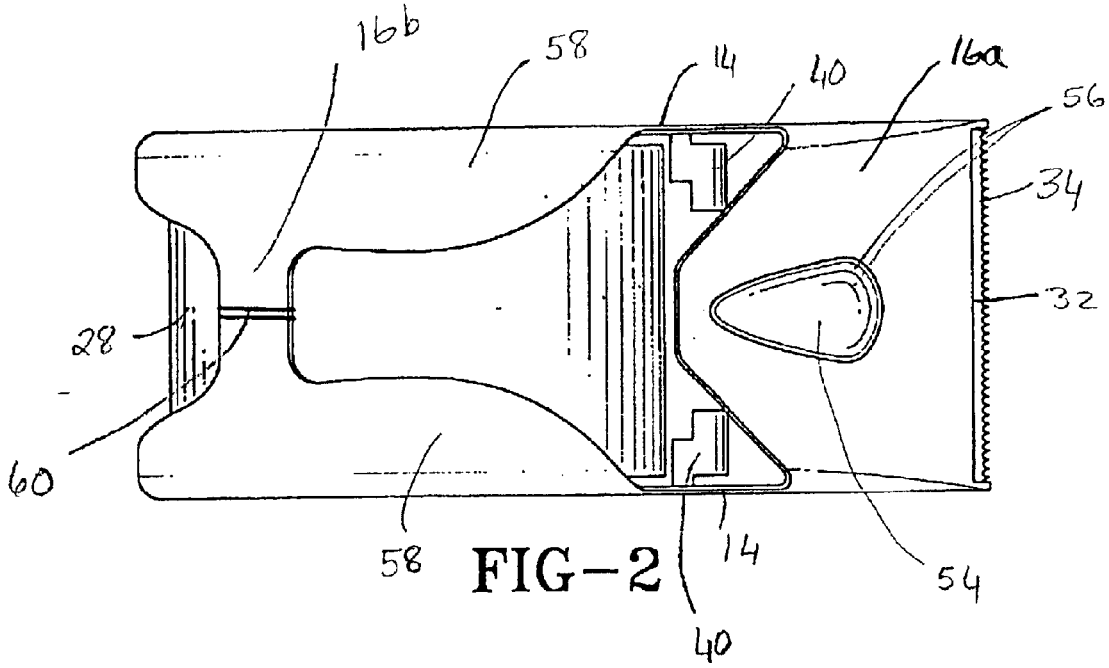
FIG. 2 is a plan view of the adhesive tape dispenser of FIG. 1.
Figure 3:
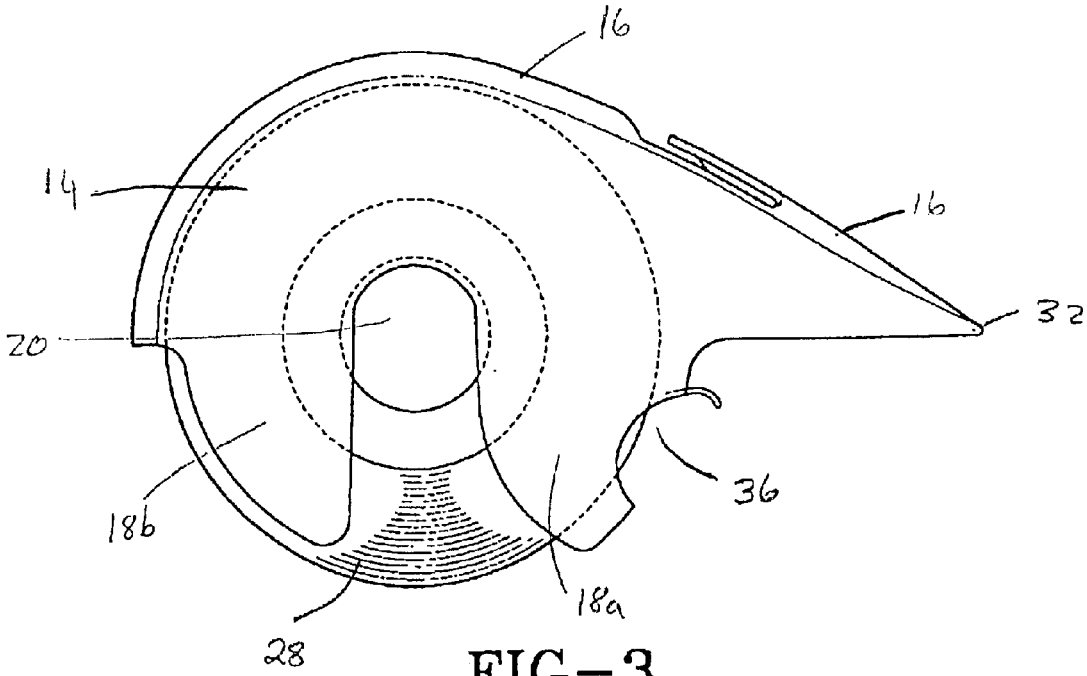
FIG. 3 is a side view of the adhesive tape dispenser of the present invention.

Referring to FIGS. 1 and 2, upper wall 16 is convexly shaped when viewed from the side and is configured so as to allow for the palm of a user's hand to easily rest thereon. Upper wall 16 preferably does not extend to the tip 48 of second leg 18*b*, but rather terminates in the proximity of ridge 46. Upper wall 16 may also preferably define an aperture 52 that allows the user to see roll 28 of tape 26 therethrough. When an aperture 52 is provided, upper wall 16 is made up of a front area 16*a* and a rear area 16*b*. Aperture 52 may be Y-shaped as shown in FIG. 1. Front area 16*a* includes leading edge 32 that is adapted to retain serrated blade 34. Front area 16*a* is provided with a generally triangularly shaped recess or recessed area 54 that is adapted to receive a fingertip (not shown) therein. Recess 54 is preferably provided with a series of corrugations 56 that resist the sliding of the fingertip therein. Recess 54 is provided in such a position that when the user grasps dispenser 10 in his palm, resting his thumb on one side wall and a finger on the other side wall, his index finger will have a natural resting place. Recess 54 is located proximate leading edge 32 and is in a good location for applying downward pressure to leading edge 32 and hence to blade 34.

Referring to FIG. 2, rear area 16*b* of upper wall 16 includes two inwardly projecting wings 58 that are configured to provide a resting place for the sides of the user's palm (not shown). Wings 58 protect the palm of the user's hand from injury as tape 26 is rapidly withdrawn from dispenser 10. Wings 58 are preferably separated by a slot 60. This allows side walls 14 to be separated partially from each other and to flex for insertion of a new roll 28 of tape 26.

Figure 4:
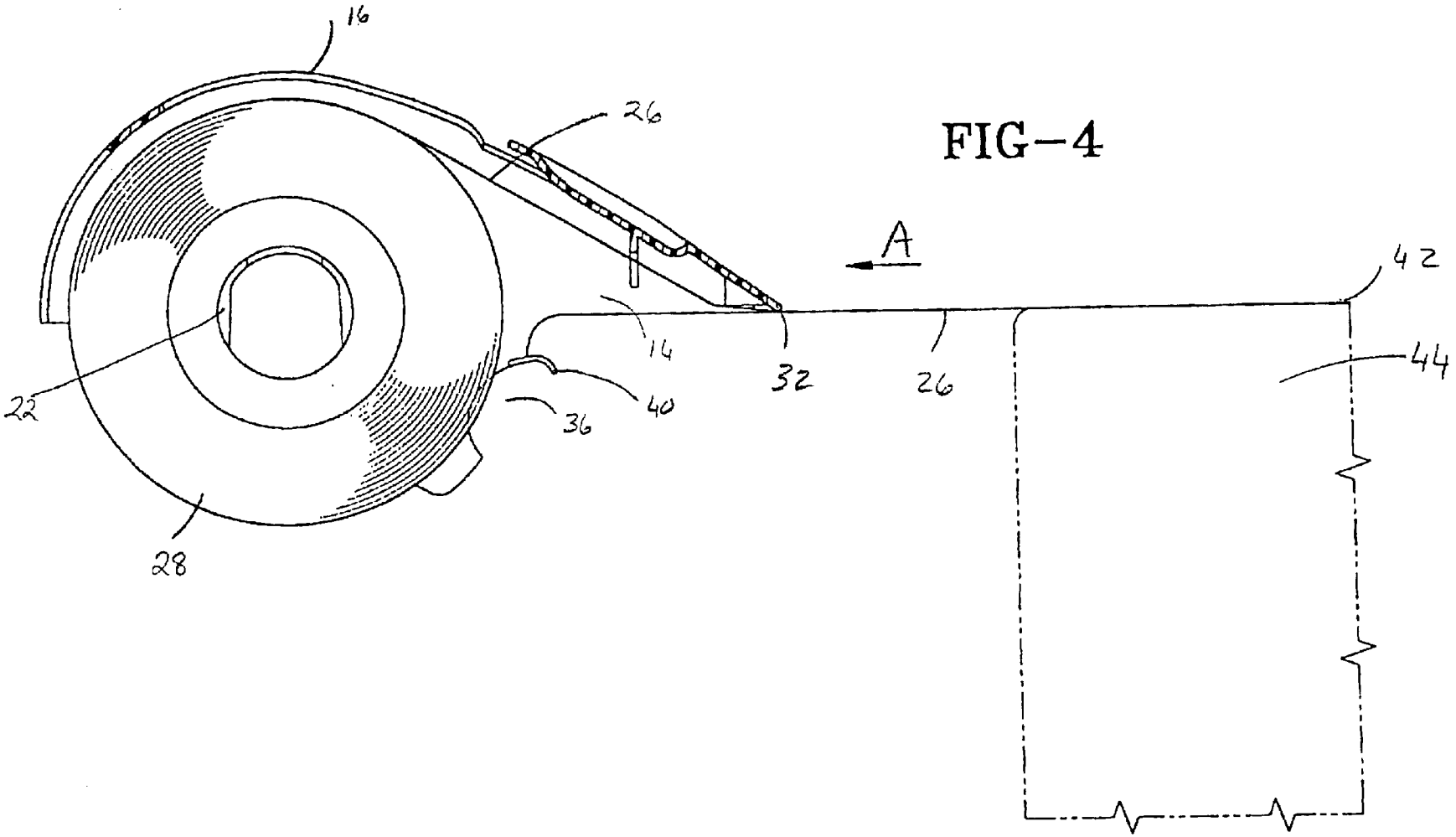
FIG. 4 is a cross-sectional side view of the adhesive tape dispenser showing the device when the tape is initially dispensed from the device.
Figure 5:
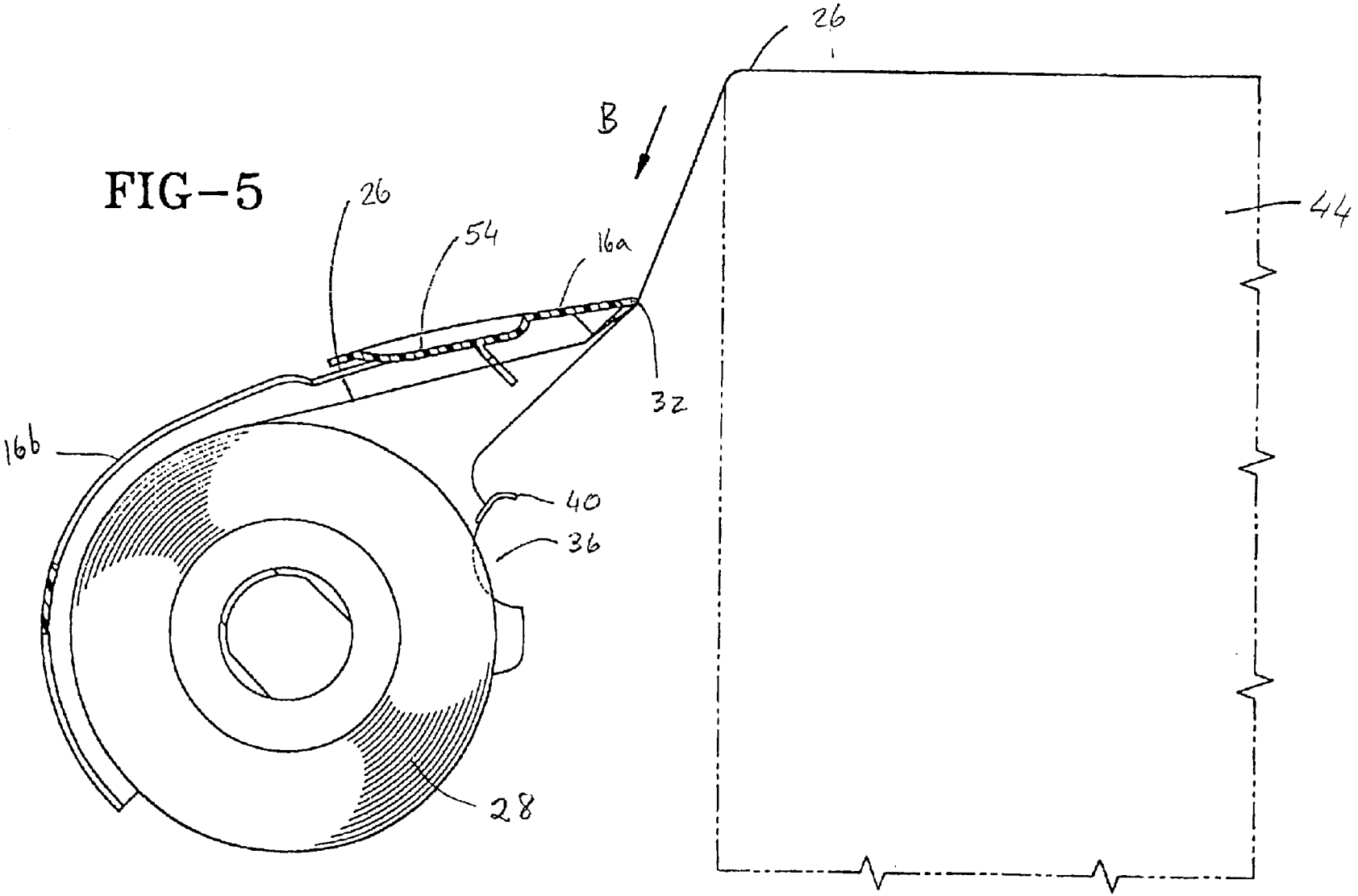
FIG. 5 is a cross-sectional side view of the adhesive tape dispenser showing the device when a second side of a package is being engaged by the tape being withdrawn from the dispenser.
Figure 6:
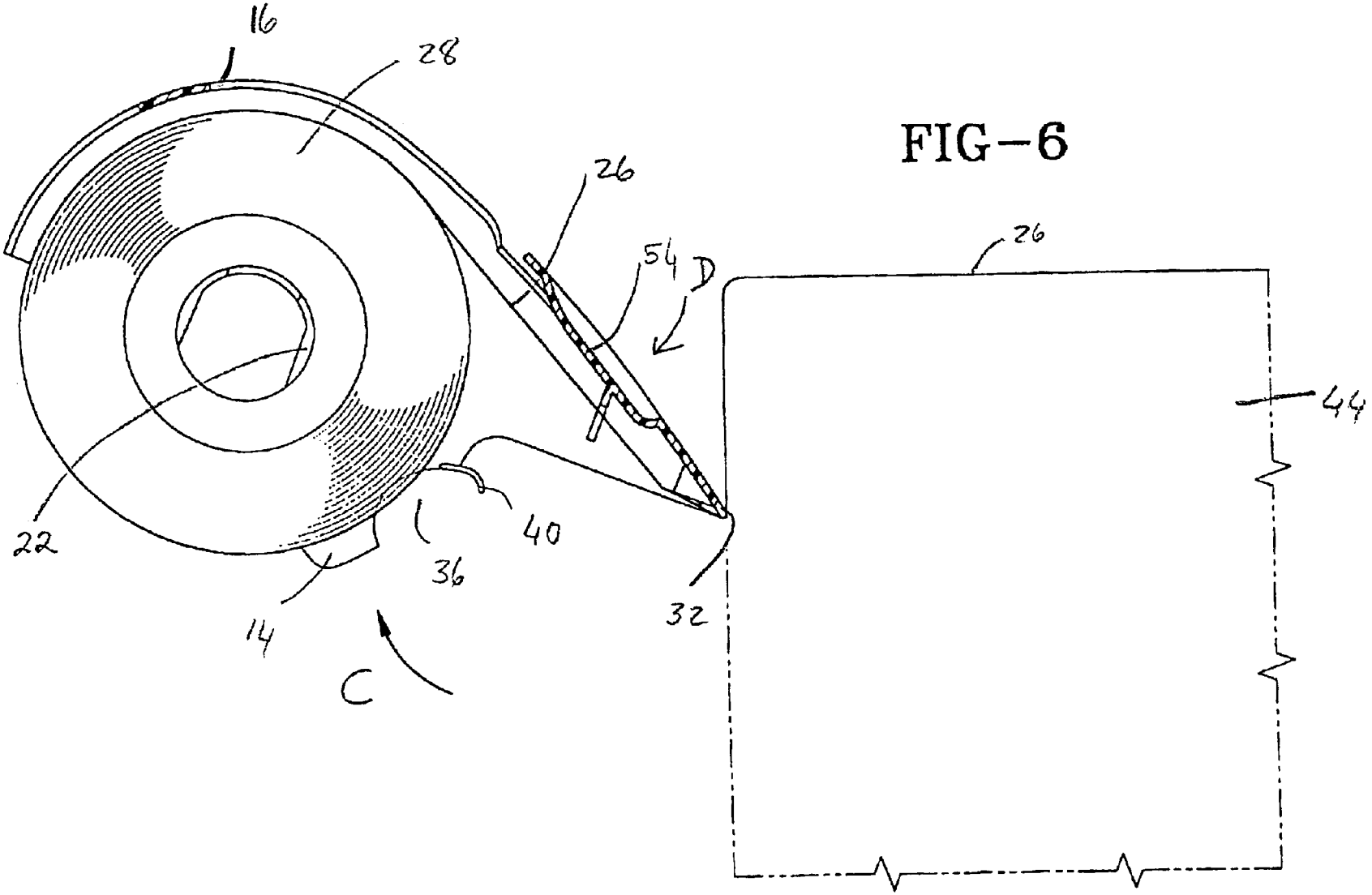
FIG. 6 is a cross-sectional side view of the dispenser when the tape is being cut.
Figure 7:
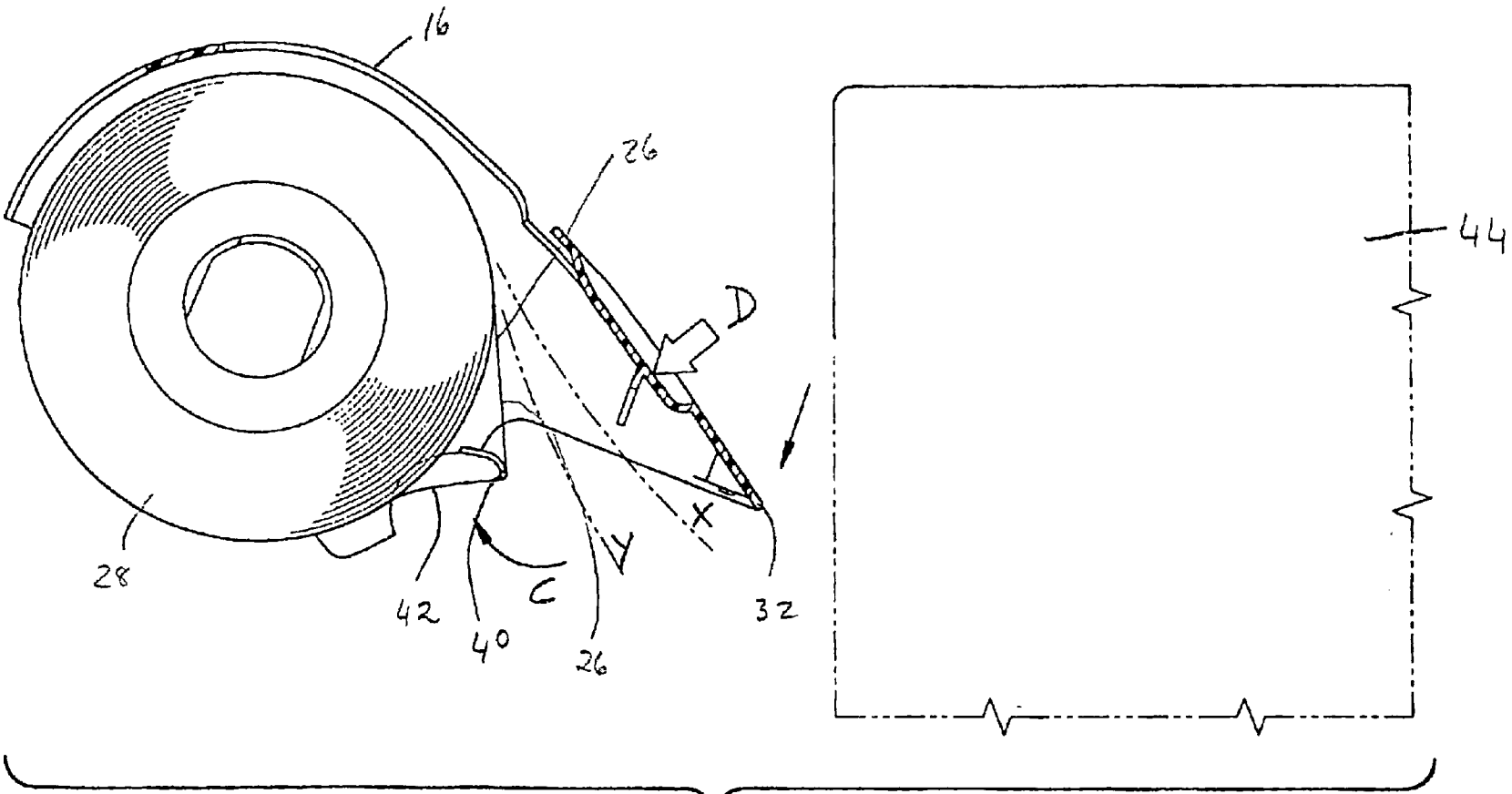
FIG. 7 is a cross-sectional side view of the dispenser showing the movement of the tape after it has been cut.

The device of the present invention is used in the following manner:

Referring to FIGS. 4–7, when the user desires to remove tape 26 from dispenser 10, he grasps dispenser 10 in the palm of one hand, resting his palm on wings 58, his index finger in recess 54 and placing a thumb on one side wall 14 and the remaining fingers of his hand partially on upper wall 16 and partially on other side wall 14. He then inserts a fingertip 38 of a finger of his other hand into indentation 36 and grasps free end 42 of tape 26. (If indentation 36 is not provided, the user lifts free end 42 of tape 26 from roll 28.) Free end 42 is then moved into contact with the article 44 to be taped and is pushed into adhesive contact with article 44. The user then pulls dispenser 10 away from article 44 in the direction of arrow A (FIG. 4). This causes roll 28 to rotate and causes tape 26 to be pulled off of roll 28. Because the user's palm rests on wings 58, the rotating roll 28 does not come into contact with his palm thereby preventing the same from suffering injury. Tape 26 contacts the underside of leading edge 32, but does not come into contact with the blade 34. The user continues to pull the dispenser rearwardly and downwardly in the direction of arrow B (FIG. 5) until the required amount of tape 26 has been dispensed therefrom. At this point, the user rotates dispenser 10 in the direction of arrow C (FIG. 6). This is accomplished by the user pushing downwardly in the direction of arrow D with their index finger located in recess. This rotation brings the serrations of blade 34 into contact with the tape 26. As the user continues to apply the downward force in the direction of arrow D and rotates dispenser 10 in the direction of arrow C, the serrations of blade 34 cut into tape 26, causing the tape 26 to be severed. As is illustrated in FIG. 7, tape 26 is severed, free end 42 thereof drops downwardly through the positions shown in phantom as "X" and "Y" until it rests against lips 40.

Figure 8:
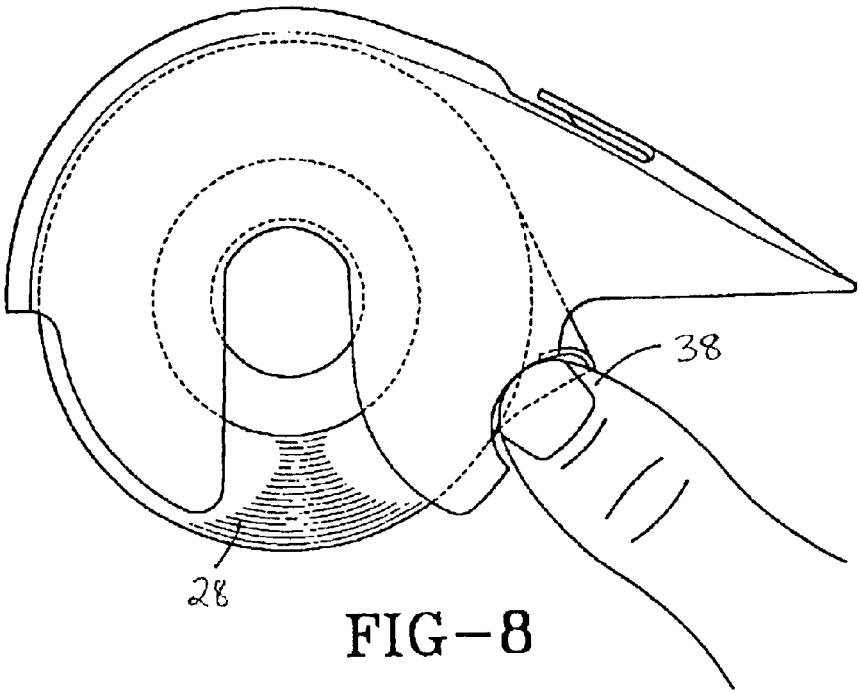
FIG. 8 is a side view of the dispenser showing how the user can capture the severed edge of the tape.
Figure 9:
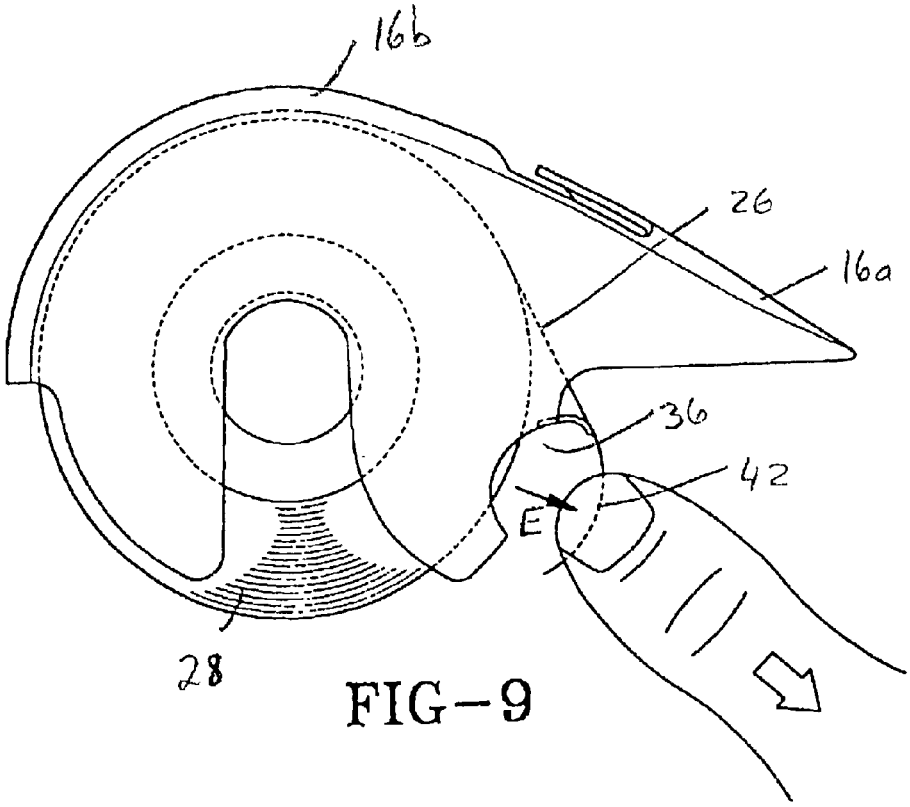
FIG. 9 is a side view of the dispenser showing how the severed edge of the tape is captured.

Referring to FIGS. 8 and 9, when the user next desires to dispense tape 26, he inserts fingertip 38 into the indentation 36 and moves fingertip 38 in the direction of arrow E. This movement lifts free end 42 off lips 40 and pulling tape 26 away from roll 28, thereby making free end 42 available for bringing into contact with an article 44 to be taped.

FIG. 10 shows a second embodiment of dispenser 110. Dispenser 110 has side walls 114 and an upper wall 116 that are configured in the same way as in the first embodiment. Front edge 30 of side wall 14 is provided with a shallow indentation 136 proximate lip 140. Lip 140 is provided to prevent free end (not shown) of tape 126 from reattaching to roll 128.

FIG. 11 shows a third embodiment of dispenser 210 having side walls 214 and upper wall 216 configured in the same way as the first embodiment, however no indentation is provided in side walls 214. Lip 240 is provided to keep free end (not shown) of tape 226 from reattaching to roll 228.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. An adhesive tape dispenser for dispensing adhesive tape, the dispenser comprising:

two spaced apart side walls, the side walls having a means for retaining a roll of adhesive tape therebetween;

an upper wall having a top surface that connects the side walls together, the upper wall having a cutting edge disposed at a first end thereof; the top surface defining a recess having a bottom wall and sides and being disposed proximate to and rearwardly of the cutting edge; whereby the top surface of the upper wall extends planarly around at least three sides of the recess; and wherein the recess is adapted to receive a fingertip of a user thereon; and wherein the upper wall includes a pair of wings that project from one side wall toward the other, the wings being adapted to receive the palm of the user's hand.

2. The adhesive tape dispenser as defined in claim 1, wherein the recess has at least one corrugation therein.

3. The adhesive tape dispenser as defined in claim 1, wherein the recess is generally triangular in shape.

4. The adhesive tape dispenser as defined in claim 1, wherein the side walls have a front edge and the front edge defines an indentation that is adapted to receive the fingertip of a user therein.

5. The adhesive tape dispenser as defined in claim 4, wherein the indentation is generally U-shaped.

6. The adhesive tape dispenser as defined in claim 4, further comprising a lip attached to the side wall of the dispenser proximate the indentation in the front edge thereof the lip projecting outwardly from the front edge toward the cutting edge and being adapted to engage a free end of the adhesive tape from the roll held in the dispenser.

7. The adhesive tape dispenser as defined in claim 6, wherein the lip is disposed closer to the upper wall than is the indentation.

8. The adhesive tape dispenser as defined in claim 1, wherein the tape dispenser has a longitudinal axis lying parallel to the side walls and wherein the wings are separated by an axially aligned slot, thereby permitting the side walls to be flexibly spread apart and a roll of tape to be inserted or withdrawn from the dispenser.

9. The adhesive tape dispenser as defined in claim 1, wherein the upper wall defines an aperture, the aperture separating the upper wall into a forward and rear section; and the rear section being the wings and the forward section having the recess defined therein.

10. The adhesive tape dispenser as defined in claim 9, wherein the aperture is generally Y-shaped.

11. In an adhesive tape dispenser having a base with spaced apart side walls that are adapted to hold a roll of adhesive tape therebetween and having a convexly shaped upper wall that connects the side walls together, the upper wall including a cutting edge for severing a piece of the tape from the roll; and wherein the tape dispenser has a longitudinal axis lying substantially parallel to the side walls; the improvement in the adhesive tape dispenser comprising:

a recessed area defined in a top surface of the upper wall and lying rearwardly of the cuffing edge; the recessed area having a bottom wall and sides; whereby the top surface of the upper wall extends planarly around at least three sides of the recess; and wherein the recessed area has a wider base portion disposed a first distance from the cuffing edge and a relatively narrower apex portion disposed a second distance from the cutting edge; and wherein the second distance is greater than the first distance; the recessed area being adapted to receive the fingertip of a user thereon and wherein the upper wall includes a pair of wings that project from one side wall toward the other, the wings being adapted to receive the palm of the users hand.

12. The improved adhesive tape dispenser as defined in claim 11, further comprising:

at least one corrugation in the recessed area.

13. The improved tape dispenser as defined in claim 11, wherein the recessed area is generally triangular in shape.

14. The improved adhesive tape dispenser as defined in claim 11, wherein the side walls of the dispenser have a front edge proximate the culling edge, and the improvement further comprises:

an indentation formed in the front edge of at least one side wall, the indentation being adapted to receive a fingertip of a user therein.

15. The improved adhesive tape dispenser as defined in claim 14, the indentation is semi-circular in shape.

16. The improved adhesive tape dispenser as defined in claim 14, wherein the improvement further comprises:

a projection extending outwardly from the front edge of one of the side walls and toward the cutting edge of the dispenser; the projection laying proximate the indentation in the front edge and extending inwardly into the area lying between the side walls; and wherein the projection is adapted to allow a cut end of a roll of adhesive tape held in the dispenser to rest thereon.

17. The improved adhesive tape dispenser as defined in claim 16, wherein the projection is disposed closer to the upper wall of the dispenser than is the indentation.

* * * * *